US005614062A

United States Patent [19]

Schulte et al.

[11] Patent Number: 5,614,062

[45] Date of Patent: Mar. 25, 1997

[54] PROCESS FOR CONTROLLING THE SEDIMENTATION OF STICKY IMPURITIES FROM PAPER STOCK SUSPENSIONS

[75] Inventors: Heinz-Guenther Schulte, Muelheim; Klaus Hornfeck, Mettmann; Dieter Kaps, Simmerath, all of Germany

[73] Assignee: Henkel Kommanditgesellschaft auf Aktien, Duesseldorf, Germany

[21] Appl. No.: 532,690

[22] PCT Filed: Mar. 30, 1994

[86] PCT No.: PCT/EP94/01000

§ 371 Date: Oct. 6, 1995

§ 102(e) Date: Oct. 6, 1995

[87] PCT Pub. No.: WO94/24369

PCT Pub. Date: Oct. 27, 1994

[30] Foreign Application Priority Data

Apr. 8, 1993 [DE] Germany ..... 43 11 599.3

[51] Int. Cl.[6] ..... D21H 21/02

[52] U.S. Cl. ..... 162/175; 162/147; 162/177; 162/199; 162/DIG. 4

[58] Field of Search ..... 162/147, 149, 162/175, 177, 199, DIG. 4

[56] References Cited

U.S. PATENT DOCUMENTS

| | | | |
|---|---|---|---|
| 3,081,219 | 3/1963 | Drennen et al. | 162/72 |
| 3,102,065 | 4/1963 | Thurlow | 162/175 |
| 4,744,865 | 5/1988 | Dreisbach et al . | 162/168.1 |
| 4,781,794 | 11/1988 | Moreland | 162/199 |
| 4,871,424 | 10/1989 | Dreisbach et al. | 162/168.1 |
| 4,886,575 | 12/1989 | Moreland | 162/5 |
| 4,919,758 | 4/1990 | Wagle et al. | 162/175 |
| 4,923,566 | 5/1990 | Shawki et al. | 162/135 |
| 5,055,161 | 10/1991 | Hoffman | 162/147 |

FOREIGN PATENT DOCUMENTS 0335575 3/1989 European Pat. Off. .

OTHER PUBLICATIONS

Wochenbl. Papierfabr., vol. 199, No. 3, 15 Feb. 1991, pp. 82–84.

H. L. Baumgarten, Das Papier, 1984, 38, No. 10A, pp. V121–V125.

J. Weigl et al., Das Papier, 1986, pp. V52–V62.

Wochenblatt für Papierfabrikation 1993, pp. 163–170.

Wochenblatt für Papierfabrikation 1990, pp. 310–313.

DIN 53282, 1995.

Eur.Comm. Communities 14011, 1992 pp. 235–243.

*Primary Examiner*—Peter Chin

*Attorney, Agent, or Firm*—Ernest G. Szoke; Wayne C. Jaeschke; Real J. Grandmaison

[57] ABSTRACT

A process for controlling the deposition of stickies from paper stock suspensions in papermaking involving the steps of: (a) providing a paper stock suspension containing stickies; and (b) contacting the stickies in the paper stock suspension with a native starch.

11 Claims, No Drawings

PROCESS FOR CONTROLLING THE SEDIMENTATION OF STICKY IMPURITIES FROM PAPER STOCK SUSPENSIONS

BACKGROUND OF THE INVENTION

1. Field of the Invention

This invention relates to a process for controlling the sedimentation of sticky impurities from paper stock suspensions in paper manufacture.

2. Discussion of Related Art

Even when paper was invented in the second century, the use of waste material, i.e. the technique of at least partial recycling, played a certain role. Nowadays, considerable significance is attributed to recycling technology through increasing ecological awareness. In view of the increasing production of paper, therefore, the supply of raw materials and the avoidance of waste are acquiring increasing significance.

By using secondary fiber stock from the recycling of wastepaper, savings can now be made in regard to raw materials, waste-disposal space and the energy required for paper manufacture. Unfortunately, this technology still involves specific difficulties.

Thus, in the processing of wastepaper, sticky impurities, normally known as stickies, can seriously disrupt the production process and adversely affect the quality of the paper produced. Stickies enter the papermaking process when the wastepaper used contains adhesive bonds, adhesive tapes or refined products, such as coated or laminated papers and paperboards. In addition, however, sticky impurities can also be formed by the resin in wood and through its interaction with paper auxiliaries.

Where the stickies are present in compact form, they can be mechanically removed relatively easily by means of sorting machines. In general, however, the stickies are present not only in compact form, but also in dispersed form in the pulp stock and are very difficult to remove in this form. Recently, therefore, the increasing use of wastepaper in paper manufacture and the restriction of the water circuits has increasingly resulted in a higher percentage of stickies in the circuit water.

Stickies cause a number of problems and disruptions not only in the papermaking process, but also in the processing of paper. On account of their stickiness, deposits are formed on machine parts, tube walls, sieves, wet felts, dry felts, drying cylinders, smoothing rollers, calender rollers and, in addition, even on the paper itself, resulting in web tears in the papermaking machine and in a deterioration in paper quality through holes, stains and marks (cf. H.L. Baumgarten, Das Papier, 1984, 38, No. 10A, pages V121–V125). According to H.L. Baumgarten, stickies in industrial and institutional publications have for years been the biggest problem in the recycling of wastepaper. Even minimum quantities of adhesive can cause tears in papermaking and printing machines, so that the machines have to be stopped for cleaning purposes. Baumgarten states: "2 g of adhesive at the right place in the papermaking machine can turn several hundred kg of paper into waste" (loc. cit., page V122, right-hand column).

Stickies have various origins. Essentially, they emanate from the resin in wood, from auxiliaries involved in paper manufacture, from binders for the coating of paper and cardboard, from adhesives for the processing of paper, from printing ink binders and from materials involved in the processing of paper. Stickies emanating from the resin in wood and from the adhesives used in the processing of paper are particularly important in the context of the problem addressed by the present invention.

The resins present in chemical wood pulp and mechanical wood pulp contain around 1 to 5% by weight of so-called harmful resins, depending on the type of wood. These resins may be present in colloidal, unbound form or may adhere to the paper fibers. According to J. Weigl et al., the difficulties caused by resin deposits in the manufacture and processing of paper have steadily increased in recent years for various reasons (cf. J. Weigl et al., Das Papier, 1986, pages V52–V62, more particularly page V53, left-hand column).

The adhesives used in the processing of paper may be divided into three groups, namely: contact adhesives, dispersion-based adhesives and hotmelt adhesives.

Contact adhesives are permanently tacky and permanently bondable products. Adhesion is achieved by application of pressure to the surfaces of the parts to be bonded. The basic polymers may be any of various key chemicals in combination with corresponding additives, for example tackifying resins, plasticizers or antioxidants. Typical basic polymers are inter alia natural rubber, butyl rubber, styrene/butadiene copolymers (SBR rubber), acrylonitrile copolymers, polychloroprene, polyisobutylene, polyvinyl ether, acrylates, polyesters, polyurethanes, silicones.

In dispersion-based adhesives, the polymers involved in formation of the adhesive layer are present as solid particles in an aqueous dispersant. In the production process, the basic monomers are first emulsified in an aqueous phase and then polymerized therein—a technique known as emulsion polymerization. The polymer is then present in the form of small particles with different particle sizes which can vary from molecularly disperse to coarsely disperse. In general, agglomeration and hence sedimentation of the monomer particles is counteracted by adding protective colloids or emulsifiers to the system.

The so-called hotmelt adhesives, also known as hotmelts, belong to the group of thermoplastics. These materials have the property of softening on heating, so that they become fluid. On cooling, they solidify again. Examples of polymers used as hotmelt adhesives include polyamides, copolyamides, polyaminoamines, saturated polyesters and ethylene/vinyl acetate copolymers.

Stickies are divided into primary and secondary stickies. Primary stickies are those sticky impurities which, on account of their high resistance, are not dispersed during wet size reduction. Accordingly, they are present in compact form and are easy to remove.

The existence of secondary stickies emanates from the fact that, during the recycling of wastepaper, the sticky impurities undergo a change in their particle size brought about by thermal, chemical and mechanical influences. This means that even impurities which are still present in extremely coarse form at the beginning of recycling can undergo more or less considerable size reduction in the recycling process. In particular, stickies are dispersed by the processes taking place in the hot kneading machines used in the recycling of wastepaper. For example, stickies with a low melting point are liquefied and then very finely dispersed. Crumbly or fragile stickies also disintegrate into very small particles. The particle size of the dispersed stickies thus ranges from coarsely disperse through colloidally disperse to molecularly disperse.

In other words, many stickies are readily dispersible with the result that, after the breaking step, they are present in finely divided form and are not picked up at the sorting stage. These substances are in danger of forming agglomerates—also known as secondary stickies—in the papermaking machine under thermal, mechanical or chemical influences. It is precisely these secondary stickies which cause problems in the further processing of paper. For example, they are transported by the paper webs, pass through the papermaking machine and thus arrive at the various places where they lead to unwanted deposits, more particularly at press felts, dry sieves, drying cylinders, smoothing rollers. In addition, they are of course also present in the paper itself, thus adversely affecting its quality.

Accordingly, it is clear from the situation outlined in the foregoing that, basically, any parameters which promote the agglomeration of particles bring with them the danger of formation of secondary stickies. The pH value and the presence of certain papermaking auxiliaries are mentioned as two very important parameters in this regard. More specifically:

Small solid particles, which touch one another or which are separated from one another by a very narrow gap, attract one another through molecular interactions, so-called Van-der-Waals forces. However, the agglomeration-promoting Van-der-Waals forces are generally not developed in alkaline medium, i.e. the medium typical of the recycling of wastepaper, because the particles are surrounded by an electrical double layer which is responsible for the mutual repulsion of particles carrying the same charge. By contrast, papermaking machines are normally operated in a neutral or mildly acidic medium, so that the repelling negative forces are reduced.

The drainability of the paper stock suspensions prepared using wastepaper is generally poor. Accordingly, auxiliaries known as drainage or retention aids are often used in practice. Retention aids are understood by the expert to be substances which bind fine fibers and fillers to the long paper stock fibers (long fibers). This binding of short fibers and fillers to the long fibers prevents the fine fibers from forming a kind of fleece which makes the paper stock suspension difficult to drain. In this way, retention aids improve drainage by binding fine fibers to the long fibers.

Retention aids can be divided into three groups, namely: organic products, such as aluminium sulfate or sodium aluminate; synthetic products, such as polyethylene imines, polyamines or polyacrylamides; and modified natural products, such as cationic starch.

The way in which retention aids work is based on the attachment of fine fibers and fillers to the paper fibers. An important mechanism in this regard is that polyelectrolytes of adequate chain length can bridge the gap between two particles and, in this way, promote the formation of agglomerates. Thus, J.L. Hemmes et al. report that cationic polyelectrolytes, for example cationic starch, are suitable as scavengers for anionic impurities (Wochenblatt für Papierfabrikation 1993, pages 163–170) .

To summarize, it may be said that, according to the present state of general specialist knowledge, a neutral or acidic medium on the one hand and the use of cationic auxiliaries to improve drainage and retention on the other hand represent conditions which promote the agglomeration of particles. With regard to the problem of stickies discussed in the foregoing, this means that the expert logically regards these conditions as favorable to the formation of stickies.

Another key role in the control of stickies is that played by temperature. The reason for this is that many adhesives belong to the thermoplastics (hotmelts) of which the tackiness increases with temperature.

In addition, it is pointed out that the manifestation of the undesirable properties of sticky impurities for the manufacture and processing of paper depends upon a number of parameters which are not yet that well known in every respect (cf. H.L. Baumgarten, loc. cit., page V122, left-hand column). Normally harmless impurities can even be converted into sticky impurities through the cooperation of mechanical, chemical and thermal influences during the production process (cf. B. Brattka, Wochenblatt für Papierfabrikation 1990, pages 310–313).

Now, there are various known methods which seek to counteract the manifestation of the negative properties of sticky impurities for the process of paper manufacture. In this connection, particular significance is attributed among experts to the approach whereby the sedimentation of stickies is suppressed by an auxiliary so that the problems caused by the adhesive properties are reduced to a technically acceptable level. The processes based on this approach are referred to hereinafter as SDC (stickies deposition control) processes.

Thus, U.S. Pat. No. 4,923,566 describes a process in which stickies are controlled with urea.

According to the teaching of U.S. Pat. No. 3,081,219, stickies in the sulfite pulping of wood are controlled with the aid of N-vinyl-2,pyrrolidone.

Attempts have also been made to control stickies by the addition of bentonites, diatomaceous earth and the like. This well-known approach is based on the idea of introducing fine particles which are capable of binding sticky impurities at their surface (cf. U.S. Pat. No. 3,081,219, column 1, lines 40–44). Another approach is based on the addition of sequestering agents, for example polyphosphates (cf. U.S. Pat. No. 3,081,219, column 1, lines 45–50). Finally, attempts have also been made to use various dispersants, for example the sodium salts of sulfonated formaldehyde/naphthalene condensates, although this leads to disadvantages at neutral pH values and to unfavorable interactions with cationic auxiliaries (cf. U.S. Pat. No. 3,081,219, column 1, lines 51–58).

U.S. Pat. No. 4,744,865 describes an SDC process in which the coagulation of sticky impurities is said to be reduced by polymers containing methoxy groups.

U.S. Pat. No. 4,871,424 relates to an SDC process using polymers containing hydroxyl groups. However, the only polymers explicitly disclosed are cellulose derivatives, such as hydroxypropyl methyl cellulose, and polyvinyl alcohol which can be obtained by hydrolysis or partial hydrolysis from polyvinyl acetate.

Finally, according to G. Galland and F. Julien Saint Amand, primary acrylate stickies can be removed by flotation in alkaline medium in the presence of soap (cf. EUR. Comm. Communities 14011, 1992 pages 235–243). By its very nature, however, this approach cannot contribute anything towards solving the problem of secondary stickies.

DESCRIPTION OF THE INVENTION

In overall terms, the prior art in the field in question is extremely heterogeneous, a completely satisfactory process for controlling stickies having still to be developed. H.L. Baumgarten's observation is still relevant today: "A glance at the problem of "sticky impurities" in wastepaper . . . shows that not only manufacturers of wastepaper recycling plants but also, and in particular, manufacturers of—mostly polymer-containing—paper refining and paper processing auxiliaries and also the chemical industry as the supplier of raw materials have a responsibility to provide close support to the paper industry." (Das Paper, 1984, No. 10A, page V124). Accordingly, there is a constant need for new and alternative solutions to the problem of controlling stickies in paper manufacture.

Accordingly, the problem addressed by the present invention was to provide a process for controlling the deposition of sticky impurities in paper manufacture which would avoid the disadvantages of known processes. This process would be generally applicable to various types of sticky impurities, but especially to contact adhesives, dispersion-based adhesives and hotmelt adhesives (hotmelts). In addition, the auxiliaries to be used in the process would have to be biologically safe and, hence, would have to satisfy the ecological requirements which are now becoming increasingly more important in the paper-processing industry. Finally, the problem addressed by the present invention would encompass in particular the problems posed by secondary stickies.

According to the invention, the problem as stated above has been solved by a process for controlling the deposition of sticky impurities (stickies) from paper stock suspensions in paper manufacture in which an effective quantity of native starch is added to the paper stock suspension.

Accordingly, the present invention relates to a process for controlling the deposition of sticky impurities (stickies) from paper stock suspensions in paper manufacture, characterized in that an effective quantity of native starch is added to the paper stock suspension.

The process according to the invention is generally applicable to the various types of stickies. However, it is most particularly suitable for solving the problems caused by contact adhesives, dispersion-based adhesives and hotmelt adhesives (hotmelts).

In one preferred embodiment, the process according to the invention is applied to paper stock suspensions which have been produced from wastepaper or from paper products containing wastepaper constituents.

Native starch (amylum) is understood by experts to be a naturally occurring polysaccharide of which the glucose units are attached by α-glycoside bonds and which is made up of straight-chain amylose and branched-chain amylopectin. Accordingly, chemically modified starch does not fall within the scope of this definition, i.e. degraded and derivatized starches do not count as native starches.

Basically, there are no particular limitations to the type of native starch used in accordance with the invention. For example, potato starch, cornstarch, rice starch or canna starch may be used. Potato starch is particularly preferred.

In addition, it has been found that the effect of the native starch suitable for use in accordance with the invention can be improved by additionally carrying out the process in the presence of a cellulose derivative. Particularly preferred cellulose derivatives are carboxymethyl cellulose, methyl hydroxypropyl cellulose and mixtures thereof.

The present invention also relates to the use of native starch for controlling the deposition of sticky impurities (stickies) from paper stock suspensions in paper manufacture.

In principle, the process according to the invention is suitable for controlling the deposition and adhesion of stickies of various kinds, i.e. differing in their chemical and physicochemical nature. However, the advantages of the process according to the invention are particularly applicable to stickies based on contact adhesives and hotmelt adhesives (hotmelts).

In principle, the native starches according to the invention may be added at any point of the overall papermaking process. They are added either in the form of solid particles or in the form of an aqueous solution or dispersion. The particular effective quantity of native starch required depends on the extent to which the wastepapers or paper products containing wastepaper constituents to be processed contain sticky impurities. In general, however, the native starches according to the invention are used in quantities of 0.001 to 5.0% by weight and preferably in quantities of 0.1 to 1.0% by weight, based on the pulp stock.

The following Examples are intended to illustrate the invention without limiting it in any way.

EXAMPLES

1. Substances and Materials Used

1.1. Polymers a) MHPC: methyl hydroxypropyl cellulose (MHPC 50, a product of Aqualon)
b) NPS: native potato starch (Viscalin 95, a product of Henkel KGaA)

1.2. Contact Adhesives a) Styrene/butadiene
b) Vinyl ester
c) Acrylate

2. Denaturing Tests

2.1. Principles of the Method

The denaturing test applied is known in principle to the expert from U.S. Pat. No. 4,886,575 and from the above-cited Article by B. Brattka (loc. cit., page 311). In this test, a selected adhesive tape is immersed in an aqueous solution containing the substance to be tested. The tapes are then stuck together under defined conditions and the adhesive force still present is determined in a universal testing machine.

2.2. Particulars of the Test Procedure

Solutions of various polymers were prepared in quantities of 200 ml and poured into 200 ml glass beakers. Various adhesive tapes were then immersed in the solutions for exactly 30 seconds. The tapes were then dried for 4 hours at a temperature of 23±1° C. Two tapes treated in the same way are then stuck together. The pressure applied was adjusted by a press to a constant value of 1 N/mm$^2$. The adhesive tapes left open at one end through the insertion of two release papers were clamped in a universal testing machine and peeled from one another at a rate of 250 mm/min. (similarly to the "Angle Peel Test" according to DIN 53282). The peel forces determined in dependence upon the selected concentration of polymer are set out in the following Tables. The peel force may be regarded as an indication of the ability of the particular polymer to exert a controlled influence on sticky formation: the weaker the force measured, the more effectively the polymer prevents the tapes from sticking to one another and, hence, the adhesive particles— ultimately responsible for the problem of stickles—from agglomerating. The values shown in the Tables represent the averages of five measurements.

COMPARISON EXAMPLE 1

| Polymer | Polymer tested: MHPC | | |
|---|---|---|---|
| | Peel strength (N/cm) for | | |
| concentration (% by weight) | styrene/ butadiene | vinyl ester | acrylate |
| 0 | 3.6 | 2.9 | 2.5 |
| 0.5 | 1.3 | 1.1 | 1.2 |
| 1.0 | 1.0 | 0.9 | 1.0 |
| 2.0 | 0.8 | 0.8 | 0.9 |

EXAMPLE 1

| Polymer | Polymer tested: NPS | | |
|---|---|---|---|
| | Peel strength (N/cm) for | | |
| concentration (% by weight) | styrene/ butadiene | vinyl ester | acrylate |
| 0 | 3.6 | 2.9 | 2.5 |
| 0.5 | 0.9 | 0.9 | 0.8 |
| 1.0 | 0.9 | 0.7 | 0.8 |
| 2.0 | 0.7 | 0.6 | 0.6 |

2.3. Discussion of the Results

It is clear from the above Tables that better results are obtained with the native starch according to the invention than with MHPC—a structurally close native polymer from the prior art.

The advantages obtained with the products according to the invention were not foreseeable in terms of degree and make it clear that starches behave entirely differently from celluloses.

We claim:

1. A process for controlling the deposition of sticky impurities (stickies) from a paper stock suspension in papermaking comprising the steps of:

(a) providing a paper stock suspension containing said sticky impurities, and (b) contacting said sticky impurities in said paper stock suspension with an effective amount of a native starch to prevent deposition of said sticky impurities.

2. The process of claim 1 wherein said native starch is selected from the group consisting of potato starch, cornstarch, rice starch, canna starch and mixtures thereof.

3. The process of claim 1 further including adding a cellulose derivative to said paper stock suspension.

4. The process of claim 3 wherein said cellulose derivative is selected from the group consisting of carboxymethyl cellulose, methyl hydroxypropyl cellulose, and mixtures thereof.

5. The process of claim 1 wherein from 0.001 to 5.0% by weight, based on the weight of dry paper stock, of said native starch is added to said paper stock suspension.

6. The process of claim 5 wherein from 0.1 to 1.0% by weight, based on the weight of dry paper stock, of said native starch is added to said paper stock suspension.

7. The process of claim 2 wherein said native starch is potato starch.

8. The process of claim 1 wherein said sticky impurities are selected from the group consisting of contact adhesives, pressure-sensitive adhesives, dispersion adhesives, hotmelt adhesives, and mixtures thereof.

9. The process of claim 1 wherein said native starch is added to said paper stock suspension in the form of solid particles, an aqueous solution, or a dispersion.

10. The process of claim 1 wherein said native starch is a naturally occuring polysaccharide having glucose units attached by alpha-glycoside bonds, and comprising straight-chain amylose and branched-chain amylopectin.

11. The process of claim 1 wherein said paper stock suspension is prepared from wastepaper or from paper products containing wastepaper.

* * * * *